US009068409B2

(12) United States Patent
Mohamed

(10) Patent No.: US 9,068,409 B2
(45) Date of Patent: Jun. 30, 2015

(54) MULTIFUNCTIONAL SCREW DRILL AND REAMING DEVICE

(76) Inventor: Leonardo Mohamed, Carapichima (TT)

( * ) Notice: Subject to any disclaimer, the term of this patent is extended or adjusted under 35 U.S.C. 154(b) by 643 days.

(21) Appl. No.: 13/508,832

(22) PCT Filed: Aug. 13, 2010

(86) PCT No.: PCT/TT2010/000001

§ 371 (c)(1),
(2), (4) Date: Oct. 17, 2012

(87) PCT Pub. No.: WO2011/056162

PCT Pub. Date: May 12, 2011

(65) Prior Publication Data

US 2013/0039703 A1 Feb. 14, 2013

(30) Foreign Application Priority Data

Aug. 19, 2009 (TT) ..... 2009/00146

(51) Int. Cl.

| | |
|---|---|
| ***E21B 10/44*** | (2006.01) |
| ***E21B 7/00*** | (2006.01) |
| ***E21B 10/62*** | (2006.01) |
| ***E21B 11/00*** | (2006.01) |

(52) U.S. Cl.

CPC ..... *E21B 10/44* (2013.01); *E21B 7/002* (2013.01); *E21B 10/62* (2013.01); *E21B 11/005* (2013.01)

(58) Field of Classification Search

CPC ..... E21B 10/44; E21B 10/62; E21B 11/005; E21B 7/002

USPC ..... 405/249, 250, 253, 257, 258.1; 175/310, 323, 394

See application file for complete search history.

(56) References Cited

U.S. PATENT DOCUMENTS

| | | | | |
|---|---|---|---|---|
| 2,352,412 | A * | 6/1944 | Sandstone | 175/325.5 |
| 3,391,544 | A * | 7/1968 | Daczko | 405/241 |
| 3,426,538 | A * | 2/1969 | Turzillo | 405/50 |
| 3,690,109 | A | 9/1972 | Turzillo | |
| 4,444,278 | A * | 4/1984 | Rocchetti | 175/108 |
| 4,942,932 | A * | 7/1990 | Bracewell | 175/323 |
| 6,641,332 | B1 | 11/2003 | Alvarado | |
| 6,902,352 | B2 * | 6/2005 | Kim | 405/269 |
| 8,033,757 | B2 * | 10/2011 | Stroyer | 405/233 |
| 8,196,681 | B2 * | 6/2012 | Bick | 175/323 |
| 2007/0175666 | A1 * | 8/2007 | Blum | 175/65 |
| 2009/0301779 | A1 * | 12/2009 | Bick | 175/45 |

FOREIGN PATENT DOCUMENTS

| | | |
|---|---|---|
| JP | 50071107 | 6/1975 |
| WO | 2011056162 | 5/2011 |

OTHER PUBLICATIONS

International Search Report dated Jul. 7, 2011, received in International Patent Application No. PCT/TT2010/000001, 4 pages.

* cited by examiner

*Primary Examiner* — Benjamin Fiorello
(74) *Attorney, Agent, or Firm* — Finch & Maloney PLLC

(57) ABSTRACT

A multifunctional screw drill and reaming device, for the testing of the structure and composition of various soil types, as well as for sampling and boring, extracting and injecting of gases and various types of chemicals as well as liquids, slurry, granules and solids. Screws can be hydraulically, pneumatically, mechanically, electrically or manually driven. Dependent upon the operation, the secondary screws (2) can rotate and change position or rotational direction within the primary screw's bore (1), or both primary (1) and secondary screws (2) can be coupled and rotate as one unit.

17 Claims, 27 Drawing Sheets

MULTIFUNCTIONAL SCREW DRILL AND REAMING DEVICE

The present application is a National Stage Filing Under 35 U.S.C. 371 of International Application Serial No. PCT/TT10/00001, filed Aug. 13, 2010. The entire above-referenced patent application is incorporated herein by reference.

BACKGROUND OF THE INVENTION

The present Invention relates to a multifunctional screw drill and reaming device, for the testing of the structure and composition of various soil types, as well as for sampling and boring, extracting and injecting of gases and various types of chemicals as well as liquids, slurry, granules and solids.

FIELD OF THE INVENTION

The present invention relates to a multifunctional screw drill and reaming device, intended for use in the testing of the structure and composition of various soil types. The present invention consists of a primary screw and secondary screws, both sets of screws being independently driven.

Screws can be hydraulically, pneumatically, mechanically, electrically, or manually driven. Sections of primary and secondary parts may be added for achieving greater depth and soil penetration.

DESCRIPTION OF THE PRIOR ART

Soil depth, time of sampling and the number of separate samples making up a composite sample, need to be standardized for the range of tests required. Nevertheless there is often a pragmatic and economical need to be flexible on the ideal standards for each test, so that desired tests may be carried out on a single retrieved sample.

Good sampling tools have been described as those that should:

1. take a small enough equal volume of soil from each sub-sample site so that the composite sample will be of an appropriate size to process for analysis;
2. be easy to clean;
3. be adaptable to dry sandy soil as well as moist sticky soil;
4. be relatively easy to use and thus provide for fairly rigid sampling of a field;
5. provide uniform cores or slices of equal volume at all spots within the composite area (James & Wells 1990).

Sampling soil tools have been classified into:

(a) blades (includes trowels, spades, shovels, spoons and knives);
(b) tubes (includes open-sided, plain-cylinder, constricted-tip and uniform-bore);
(c) augers (includes wood-bit, post-hole and sheathed) (Cline 1944).

Many of these sampling tools will not meet the requirements for good sampling tools. Blade-type tools will often take tapered slices of soil unless held strictly vertical. Tapered slices or cores may bias the analysis as they will generally give an uneven weighting of soil in favour of the enriched surface. In stony soils and heavy clay sub-soils, augers may be the only tool that can penetrate the medium. However, they will not take uniform cores and can easily cross-contaminate soils from different depths or horizons. In general, assessment to tube samplers has been favorable (Brown 1965; Vimpany 1966; Hennig & Schaffter 1973; Terry et al, 1974; Vimpany & Bradley 1980) and they are the preferred sampling tool to use wherever possible.

A few studies have been conducted on the effect of core diameter on soil test variability and have generally found that variation decreases with increasing diameter (Skene & Hosking unpubl. data). This would indicate that fewer cores per site may need to be taken when using large-diameter samplers or, conversely, more cores are required with small-diameter samplers. However, there is a limit to the diameter of a tube sampler that should be used in field sampling. Large diameter cores rapidly increase total sampling volume and may cause practical problems in sample transport and handling. There is necessarily a compromise between the number of cores that should be taken for a composite sample and the total volume of soil in a composite that can be effectively handled either in the field or during the laboratory preparation without introducing further error associated with sub-sampling (McIntyre 1967).

Sampling tools are often constructed from stainless steel. Other metals can be a cause of contamination, which is of concern where trace elements analyses are to be performed. Lubricants are sometimes used, particularly on deep-core sampling tubes but can cause error in organic carbon analysis (Dowling et al, 1985).

Manually operated sampling tools allow the operator to examine each sample individually before acceptance and enable modification to the sample extraction, if necessary. For example, as depth of sampling is often critical, it is important to ensure that a full core is extracted (i.e. the bottom part of the core has not broken off and fallen from the sampler). In dry sandy soils or cultivated land, the sampler may need to be forced into a near-horizontal position, while still in the ground, before being listed out.

Mechanically driven sampling tools are increasingly being used to ease the sampling process, particularly where subsurface samples are required (Bolland et al. 1994). When using such apparatus, it is important to take some trial samples first to ensure that the full soil depth required is being collected and that distortion of each sub-sample does not occur. For example, in a wet plastic soil or dry cultivated soil, surface compression by the sampler may result in non-standard depths being sampled. In addition, unless operators take care, mechanical samplers operated from vehicles may sample atypical spots (e.g. dung, fertilizer granules), as would analysis of samples of soil from different paddocks or blacks on a farm often give different results (Robertson & Simpson 1954; Grayley et al. 1960) Hosking 1986c). This is particularly so for nutrients such as extractable phosphorus or extractable potassium and can generally be related to differing soil sub-strata.

The Model 0200 Soil Sampler allows the extraction of intact soil cores. A core 2-¼" (5.7 cm) in diameter is extracted and held in a brass cylinder. The cylinder and soil sample can then be placed in a pressure plate extractor or Tempe cell apparatus, and the water-holding characteristics of the sample can be determined. The cylinder can be used to provide a sample of known volume, allowing the bulk density to be determined. The sampler is supplied with two wedge coring tips, driving hammer, core extractor, spanner and strap wrench for replacing coring tips, six cylinder caps, and five brass cylinders; one 6 cm long, two 3 cm long, and two 1 cm long.

The Model 0212 Soil Sampler allows the extraction of intact soil cores. A core 3-½" (8.9 cm) in diameter is extracted and held in a brass cylinder. The cylinder and the soil sample can then be placed in a pressure plate extractor or Tempe cell apparatus and the water-holding characteristics of the sample can be determined. The cylinder can be used to provide a sample of known volume, allowing the bulk density to be determined. The sampler is supplied with two wedge coring tip, hammer, spanner wrench for replacing coring tips, and six brass cylinders; two 6 cm long and four 3 cm long.

The Model 0215 Soil Sampling Tube produces a smooth-walled hole, 1-¼" (3.2 cm) in diameter, while extracting a soil sample ¾" (1.9 cm) in diameter. The optional drop hammer is used to help insert the sampler into the soil, and to remove the sampler and extract a soil sample. An optional Puller Jack, Model 0220, is available to aid in removing the sampler from the soil.

The Lord Soil Sampler is 3 feet (0.91 m) in overall length and 1 inch (2.5 cm) in diameter and is made from tough, chrome-moly steel. A one-foot opening on the side permits easy removal of the sample from the polished, nickel-plated unit. The coring tip is replaceable and fabricated from heat-treated nickel-plated tool steel. The handle unscrews at the top to permit addition of a 2-foot (0.68 m) extension tube for deep sampling. The sampler, as well as extension tube, is marked at 6" (15.2 cm) intervals for depth measurements.

LYNAC® Sampler is an industry standard split barrel sampler. It includes a shoe, barrel and head with optional "fast threads" to speed assembly and disassembly. Optional tapered threads (AWJ). Normally driven by a 140 lb. Safety Hammer, an In-Hole Sampling Hammer or SPT Automatic Hammer.

The sampler barrel has a tongue and groove design to facilitate reassembly of the barrel and a heat-treated shoe to better withstand severe driving conditions. In addition, a ball check valve prevents wash-out during removal from the hole and the shoe design accommodates a Flap Valve or Spring Retainer.

This split tube sampler is designed for taking soil samples at the bottom of the cleaned bore hole by the drive weight method. The split section is held together with a ball check head and a hardened steel drive shoe. The ball check feature in the head prevents samples from being washed out of the sampler upon withdrawal from the hole. The sampler is designed to accommodate a brass, plastic, or paper tube liner for collecting and carrying samples to the field office. Two sample lengths are available.

Noting steps in tube design, Drilling World's heat treated drive shoe is recessed to accommodate various accessories. All assemblies are designed to accommodate liners which facilitate transportation of samples to laboratory without disturbing soil samples. MI-purpose sampler used for visual classification, contamination content and moisture determination. The split barrel permits removal of a sample as it is taken from the ground. Generally driven by a 140 lb (63.5 kg) safety hammer, an in-hole sampling hammer or SPT Automatic Hammer. Samplers are available with both standard and (AWJ) thread design. Sizes are identified by sampler O.D.

The "Shelby" Tube sampler is the simplest and probably most widely used of the "in-situ" quality samplers. It consists of a head section which contains a check valve and drill rod box connector and a thin wall sample tube. The tube is loosely attached to the head by means of four cap screws which are turned "in", or clockwise, to remove the tube. "Shelby" samplers are furnished complete with ball valve for positive vacuum control. This sampler should be forced down under steady pressure. Standard tube length is 2'6" (762 mm).

In patent application no.PCT/F193/00512 (WO 94/12760) the invention relates to a drilling apparatus including a drilling device that is intended to be fed into a hole to be drilled and which is preferably extendable in the longitudinal direction. The drilling device comprises a casing part essentially inside of which there is at least during a drilling situation a drilling unit in the drilling head of which there are at least a first drilling means for drilling a center hole and a second drilling means for reaming the center hole for the casing part as well as a flushing means for removal of the drilling waste.

At least during the drilling situation the rotational movement around the longitudinal axis and the impact movement in the longitudinal direction of the first drilling means is transmitted by a counterpart assembly to the second drilling means that is drivingly connected to the first drilling means essentially at the drilling head of the drilling unit, wherein the second drilling means is arranged to rotate in connection with the head of the casing part centrically around the longitudinal axis by a coupling assembly.

The first drilling means is arranged detachable from the second drilling means for removing the first drilling means from the prepared hole, while at least the second drilling means is left in the bottom of the hole. For example Patent Publications GB-959955 and GB1068638 disclose drilling arrangements such as the above. The solutions described in both mentioned publications comprise inner drilling means, in other words the center drill for drilling the centerhole and outer drilling means that is symmetrical in relation to the longitudinal axis of the drill and the leaving of which in the hole together with the casing part after the drilling situation is made possible.

In such an arrangement, thanks to the centrical rotation movement of the outer drilling means or in other words the reaming drill, the risk of breakage of the drilling arrangement is rather small, especially compared with currently widely used drilling arrangements having eccentric reaming drills.

The contact surface of the reaming drill according to the solution presented in the Patent Publication GB959955 touches the head of the casing part from the inside. In this case the effective diameter of the center drill is reduced also by the twist locking and impact surface assemblies between the center drill and the reaming drill. The mentioned publication presents two differing solutions, wherein as the twist locking assembly in the first solution a shape locking has been applied between the drilling means and in the other one a bayonet coupling between the same.

Accordingly, the impact surface assembly comprises a recess-projection assembly between the reaming drill and the center drill that is situated in the front edge of the said twist locking assembly. In a solution described above, the casing part has to be fed into the hole to be drilled by influence of the center drill, wherein the feeding movement is transmitted by means of the counterpart assembly through the reaming drill, in which case the casing part follows the reaming drill. Thus it is practically possible that the impact movement of the center drill is transmitted at least partially also directly to the casing part.

The Patent Publication GB-1068638 discloses a solution in which the reaming drill is placed end to end with 35 the head of the casing part. In this case there is an internal socket fixed in the reaming drill, which is placed in contact with the inner surface of the head the casing part. In the head of the casing part and in the socket there is a recess-projection assembly, by influence of which the socket remains in place in the longitudinal direction, however allowing rotation of the socket in relation to the casing part. In the solution above there has also been applied an additional block in connection with the arm of the center drill, which couples the rotational movement, feeding movement and impact movement of the center drill to the reaming drill by influence of the socket.

It is common to solutions according to those above, that the effective diameter of the center drill is relatively small, that is about 50% of the inner diameter of the casing part. Naturally this is why it is necessary to apply excessively massive drilling rods, which naturally raises the manufacturing costs of the drilling arrangement explained above.

Additionally the massiveness of the constructions is also a reason why the handling of the parts of the drilling arrangement is difficult, besides the usage of which demands high capacity. That is why the solutions of above explained types have currently not been used too much in practice, though a centrically rotating reaming drill has many significant advantages compared especially with so called eccentric reaming drills.

Furthermore, existing solid and liquid manure spreaders are not well adapted for surface spreading or direct subsurface injection of semi-liquid dairy cattle manure. By taking into account the characteristics of this type of manure, a machine for either spreading or injecting semi-liquid manure was designed and constructed. Its manure handling system consisted of a tiltable tank connected to a vibrating distribution manifold that directed the manure to the spreading or injection devices. Manure was fed to the injectors by gravity via 152 mm (6 in.) diameter hoses. The 305 mm (12 in.) wide injectors were operated at depths not exceeding 203 mm (8 in.) in order to reduce draft requirements. Results from preliminary field testing of the prototype are reported along with the design modifications that were recommended following these tests.

The present invention doesn't have to consolidate the samples and can remove only the specific area required for sampling. Consolidated samples are samples taken from sampling tools e.g. Direct push system and some auger type tools.

These sampling tools start taking in the soil or product matter from entry and upon reaching the sampling area, the tool is filled with a lot of unwanted matter which mixes with the sample.

It is an important object of the present invention, to achieve a decisive improvement in the problems presented above and thus to raise substantially the level of knowledge in the field in keeping with the state of the art.

It is a further object of the present invention, to provide a reaming device in which there is no binding or sticking of the tool during operation.

Yet another object of the present invention is to provide a reaming device which can rotate and change position or rotational, direction within the primary screw's bore.

Still an additional object of the present invention is to provide a multifunctional screw drill and reaming device, in which both primary and secondary screws can be coupled and rotate as one unit.

Furthermore an additional object of the present invention, is to provide a multifunctional screw drill and reaming device, in which both primary and secondary screws may be hydraulically, pneumatically, mechanically, electrically, or manually driven.

Additional objects and advantages of the present invention will become apparent, as the following detailed description of the preferred embodiment is read in conjunction with the drawings and the Claims.

DETAILED DESCRIPTION OF THE PREFERRED EMBODIMENT

The present invention is intended to create an aperture in a given location in the soil and is extendable in the longitudinal or latitudinal direction.

Figure 13:
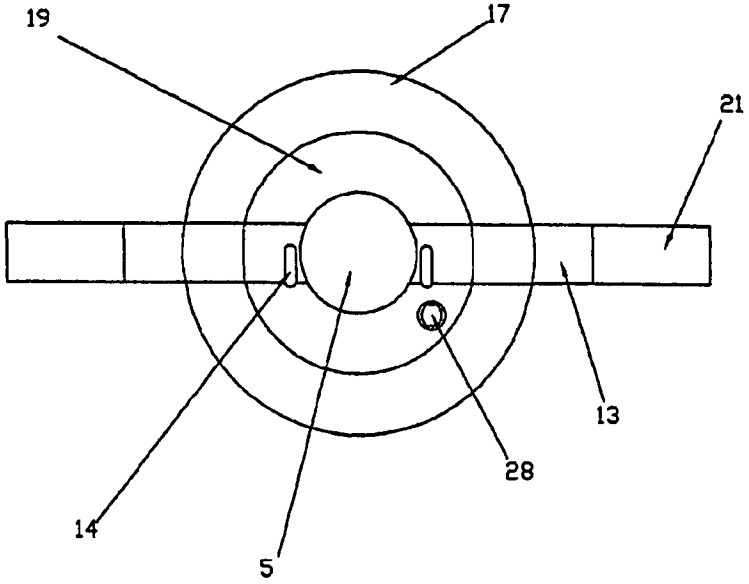
FIG. 13 is an overhead perspective view of the present invention.
Figure 14:
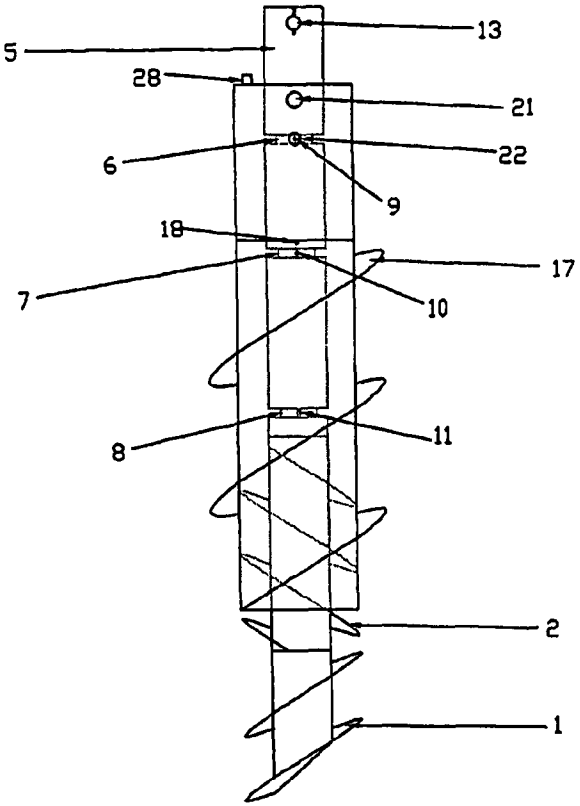
FIG. 14 is a side perspective view of the secondary drive shaft in position No. 6, boring vertically or horizontally into the subject matter (1st procedure).
Figure 15:
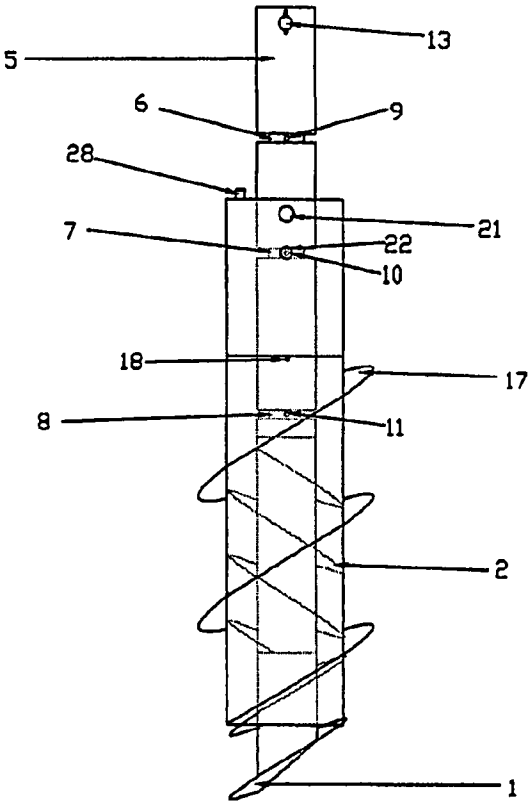
FIG. 15 is a side perspective view of the secondary drive shaft in position No. 7, removing a disturbed sample ($2^{nd}$ procedure. Part 1).
Figure 16:
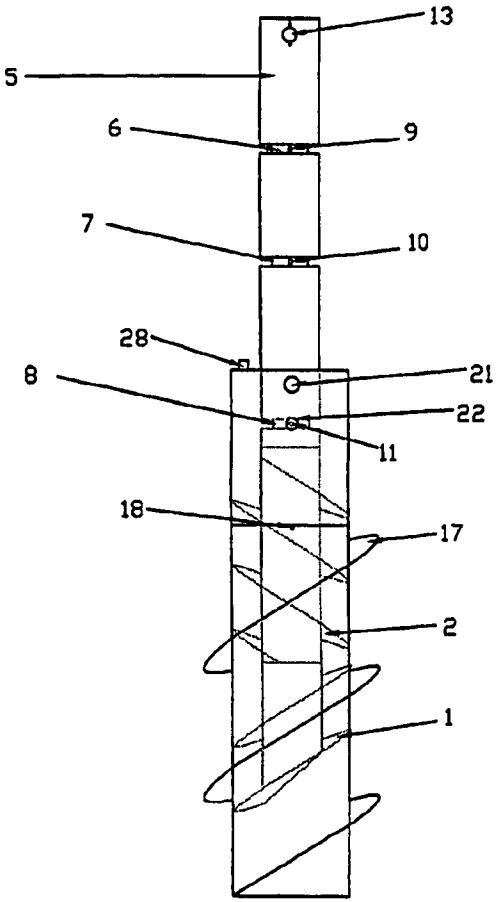
FIG. 16 is a side perspective view of the secondary drive shaft in position No. 8, removing an undisturbed sample ($3^{rd}$ procedure)
Figure 17:
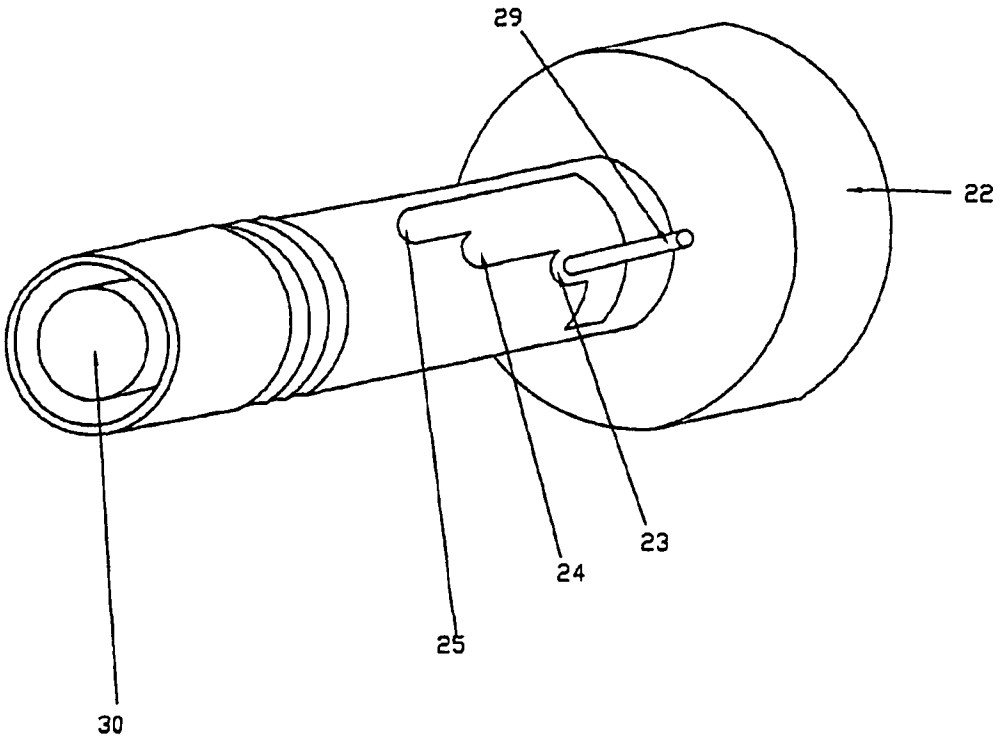
FIG. 17 is an isometric view of adjuster No. 22 as adjustment No. 23 moves the adjusting pin (No. 30) away from the secondary drive shaft No. 5, giving the secondary drive shaft the required clearance to move to its three positions (Nos. 6, 7 & 8).

All rotation mention is referred to FIG. 13 the overhead perspective view of the present invention.

The present invention consists of a primary forward screw drill (No. 17), a secondary forward screw drill (No. 1) and reverse (No. 2) screw drill, said aforementioned screw drills being independently driven. Dependent upon the operation, the secondary screws (Nos.1 & 2) can rotate and change position or rotational direction within the primary screw's bore (No. 17), or both primary and secondary screws can be coupled and rotate as one unit.

The primary drive shaft (No. 19) connects and drives the primary forward screw drill (No. 17) and incorporates drive handles (No. 21), hose coupling (No. 27) and an adjuster (No. 22) (FIGS. 1,17, 18 & 19) with three adjustments(Nos. 23, 24 & 25).

Adjustment No.23 (FIG. 17) allows the secondary drive shaft (No.5) to move from one position to another (Nos. 6, 7 & 8).

Adjustment No. 24 (FIG. 18) allows the secondary drive (No. 5) to rotate in any one of its positioning grooves (Nos. 6, 7 & 8).

Adjustment No. 25 (FIG. 19) Allows the secondary drive shaft (No. 5) to couple with the primary drive shaft (No. 19) and rotate as one unit in any of its locating slots(Nos. 9, 10 & 11).

In a clockwise rotation (FIG. 13), the primary screw drill bit (No. 17) penetrates, the primary screw executes the majority of penetration and in operation, removal of all unwanted material passes along its outer diameter screw, no unwanted material passes through the primary bore, hence there is no binding or sticking of the tool during operation. In an anticlockwise rotation (FIG. 13), the primary forward screw (No. 17) will exit the targeted sampling area The secondary screw drills are housed within the primary screw drill's bore while the secondary drive shaft (No. 5) with drive handle (No. 13) and locking clips (No. 14) keep the drive handle in position, connects and drives the secondary forward (No. 1) and reverse (No. 2) screws, the secondary drive shaft (No.5) has 3 locating grooves( Nos. 6, 7 & 8) and 3 locating slots (Nos. 9, 10, & 11).

The positioning grooves (Nos. 6, 7 & 8) allow the secondary forward (No. 1) and reverse (No. 2) screws to rotate, in 3 different positions within the primary screw's bore (FIGS. 2, 3, 6, 7, 8, 14, 15, 16, 20, 21, 22, 23, 25, 26 & 27).

The positioning slots (No. 9, 10 & 11) couple the primary (No. 17) and secondary forward (No.1) and reverse (No. 2) screws in 3 different positions within the primary screw's bore (FIGS. 4, 5, 9, 10, 11, 12 & 24).

The secondary forward (No. 1) and reverse (No. 2) screws are comprised of two screws on one shaft. The first secondary screw assists the primary screw in penetrating and penetrates in a clockwise rotation. Dependent upon the subject matter for penetration, the forward screw (No. 1) can be replaced with different cutting tips.

The secondary screw (No. 2) maintains a clear bore within the primary screw, until the boring, vertical or horizontal is completed. The reverse or secondary screw (No.2) expels matter in a clockwise rotation.

Rotating both screws in the same or opposite direction, the primary screw entering or exiting and the secondary screw pushing or pulling can only be accomplished by screw design. Sections of primary and secondary parts may be added for achieving greater depth penetration.

Consisting of a primary screw and secondary screws, both sets of screws being independently driven, hydraulically, pneumatically, mechanically, electrically or manually and comprising:

(1) A primary drive shaft which connects and drives a primary forward screw drill, incorporates drive handles, hose coupling and an adjuster with 3 adjustments.

(2) A secondary drive shaft with 3 locating grooves and 3 positioning slots, connects and drives.

(3) A secondary reverse screw with female and male splines, a secondary forward screw with male splines, locating pins and locking clips to couple with male and female splines.

(4) A secondary drive handle and locking clips to keep said drive handle in position.

The said invention can be used for

Boring.

Sampling and extracting.

Injecting.

The present invention can retrieve an undisturbed or disturbed sample, at any given depth, without any cross contamination and retain the integrity of each sample.

In clockwise rotation—The tool enters the subject matter, the inner bore of the primary screw which is used to hold the sample on the secondary reverse screw, is always clear. This happens because the reverse screw expels in a clockwise direction, keeping the primary sampling bore clear of any matter.

While the present invention is moving from depth to depth, no matter enters the sampling bore and therefore there is no cross contamination. The present invention may be cleaned after taking of each sample, flushing with steam and hot water through hose coupling (No. 27).

To remove a disturbed sample at any given depth and remove that area only required for sampling is possible by changing rotation or position of the secondary forward and reverse screw, which is housed within the primary screw's bore, at the depth required to remove the sample.

Removing an undisturbed sample may be done by changing the position of the secondary forward (No.1) and reverse screw (No.2) which is housed within the primary screw's bore (No.17), at the depth required to remove the sample while the present invention is in operation, and will only remove that area needed for sampling.

At the required sampling depth, rotation of both screws are stopped, the secondary screws (Nos. 1 & No. 2) are pushed up the primary bore leaving the required clear bore for the undisturbed sample. The primary screw is then rotated in a clockwise direction moving further into the subject matter, the sample is then compacted into the free bore within the primary screw, after the sampling distance has been completed rotation of the primary screw is stopped. The primary screw is then rotated in an anticlockwise direction for removal. The present invention is held over a collecting bin, the samples which were compacted into the primary screw's free bore (No.17), within the primary bore there is a removable cylinder (No. 15) with the compacted sample, the cylinder is removed with the sample.

This present invention can also be used as a medium for the extraction of soil vapour for testing or venting by connecting a vacuum pump to the top of the tool. Extraction takes place through the primary bore. When a larger soil area needs gas extraction or venting, a modified primary screw with drilled holes can be used (FIG. 27), (No.33). Extraction can now take place at the extraction point and along the drilled holes on the primary screw. This is possible because the inner bore of the present invention is always clear and there is no clogging of sampling point while in operation. Due to the design of the reverse screw, which is part 2 of the secondary screw, clockwise rotation expels any matter that may attempt to enter the primary bore, therefore, maintaining a clear primary bore.

The reverse screw (No. 2) is housed in the primary screw's bore exposing approximately 3" to 4" ensuring no matter enters the primary bore. The present invention can move from depth to depth while gas sampling is being done and this sampling can be done at any given depth as follows:

1. Clockwise rotation

A) Maintains a clear bore within the primary screw.

B) The secondary reverse screw (No. 2) expels in a clockwise rotation.

C) To inject at the appropriate depth.

2. Anticlockwise rotation

A) To retrieve any sample.

B) To load or fill the injector.

The secondary reverse screw (No. 2) when coupled with the primary screw (No.17), and used as an injector will hold the subject matter for injection, while the present invention is in operation and release the matter at the appropriate depth.

Injecting any type of gas or liquid—a high pressure hose with the product to be injected is connected to the top of the primary bore, the injection tool injects from within the primary bore to the base of the present invention. Injection of gas or liquid may be needed in a larger area, not only at the injection point. A modified primary screw with drilled holes can be used to inject. Injection takes place at the injection point and along the drilled holes of the primary screw. Having a high pressure hose connected to the present invention is mainly used for gases. Liquids can be used with a high pressure hose or gravity fed. The secondary screws can be rotated in a clockwise direction to maintain a clear bore.

Boring: Together the action is the boring and removal of debris, to eventually reveal a tunnel, no material is transferred through the primary bore, while boring is in operation. The primary screw remains at the desired horizontal distance. The secondary screw will be removed leaving a clear bore. The primary screw's bore can be used as a pipeline under a roadway, pass, or through a mountain.

This pipeline can be used for almost any type of liquid, gas, electrical cables etc. This pipeline application can be used for drainage purposes.

The main advantage which the present invention has over the prior art is, it does not allow any debris to pass through the primary bore like the existing tools, but instead allows the debris to pass at the outer primary screw. The primary screw executes the majority of penetration and while penetrating, removal of all unwanted material passes on its outer diameter screw, no unwanted material passes through the primary bore, hence there is no binding or sticking of the said invention during operation and simultaneously, the secondary forward screw No. 1 and reverse screw No. 2 are being rotated in a clockwise direction within the primary screw's bore.

Figure 18:
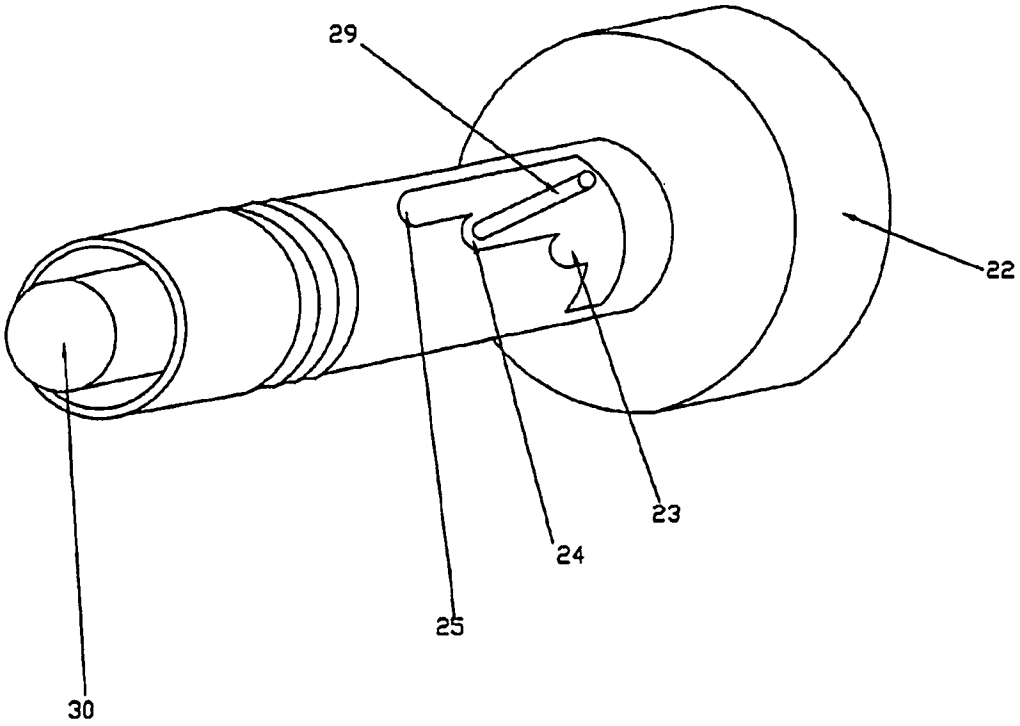
FIG. 18: is an isometric view of adjuster No. 22 as adjustment No. 24 moves the adjusting pin (No. 30) towards the secondary drive shaft (No. 5) allowing the secondary drive shaft to rotate along any of its rotating grooves (Nos. 6, 7 & 8).

Boring vertical or horizontal 1$^{st}$ procedure with secondary drive shaft No. 5 rotating in position No. 6 and the primary drive shaft adjuster No. 22 is set to adjustment No. 24. (FIG. 18) when adjuster No. 22 is set to adjustment No. 24 the secondary drive shaft can rotate within the primary (No. 17) screw's bore (FIG. 18).

The secondary forward screw and secondary reverse screw are made up of two screws on one shaft and with the secondary drive shaft (No. 5) rotating in position No. 6, the function of the secondary screws are as follows (FIGS. 2, 3 &14):—

(1) The secondary screw assists the primary screw in penetrating any subject matter in a clockwise direction.

(2) The secondary reverse screw maintains a clear bore within the primary screw, at all times and keeps pushing the material forward, feeding the primary screw, allowing material to stay at the front of the primary screw in order to move to the surface, or up or along the primary screw, until the vertical or horizontal boring is completed. The reverse screw expels in a clockwise direction.

At this point in operation the secondary forward screw is exposed to the subject matter and the majority of the secondary reverse screw is housed in the primary screw's bore exposing part of the secondary reverse screw, ensuring that the intended subject matter of attention doesn't enter the primary bore. After boring has been completed, rotations of both primary and secondary screws are stopped and the following procedures for sampling, extracting and injecting are executed. The primary screw is rotated anticlockwise to remove it from the subject matter, or the primary screw remains at the desired location and the secondary screws are removed leaving a clear primary bore.

Figure 1:
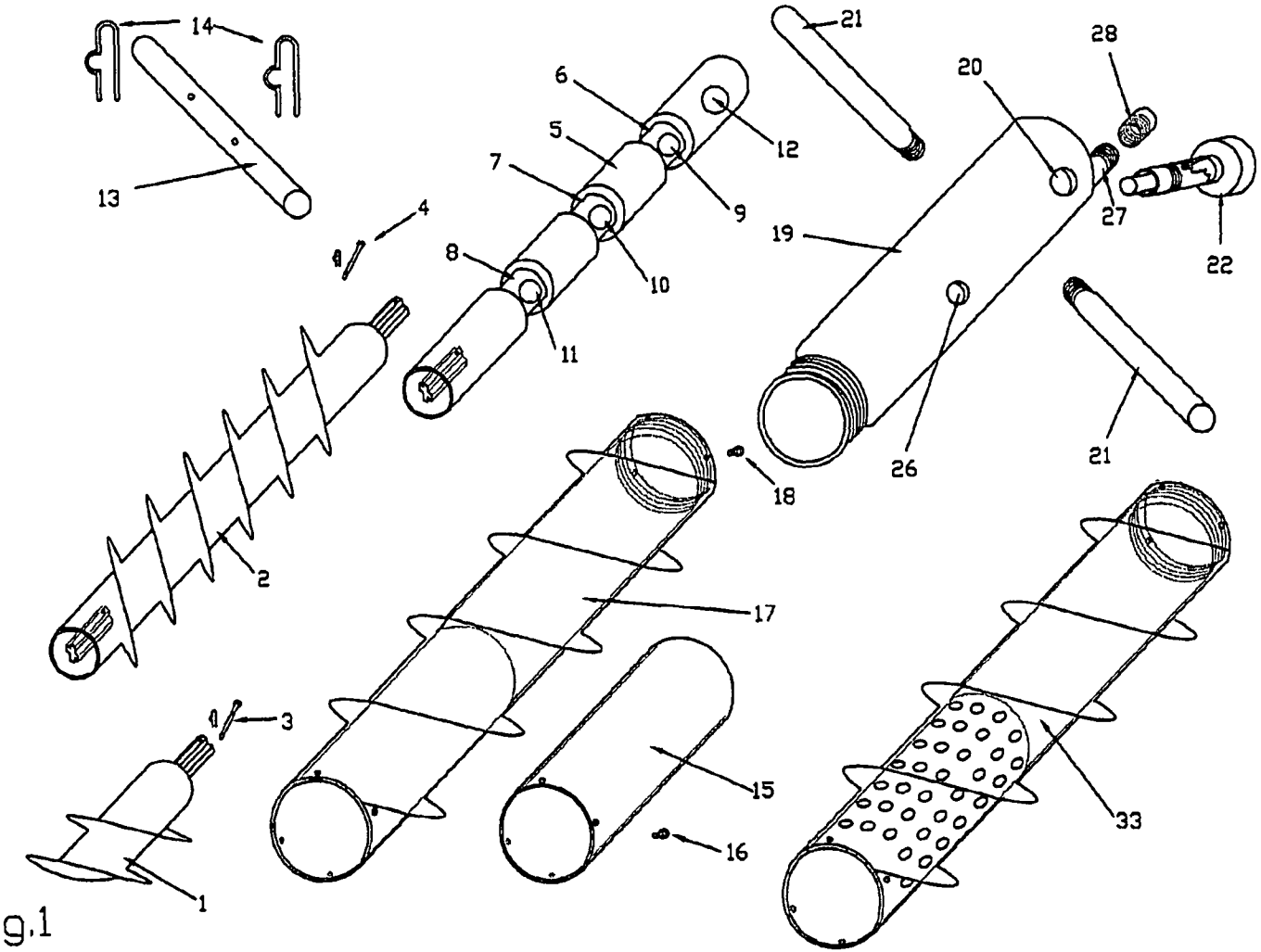
FIG. 1 depicts an exploded isometric view of the present invention.
Figure 2:
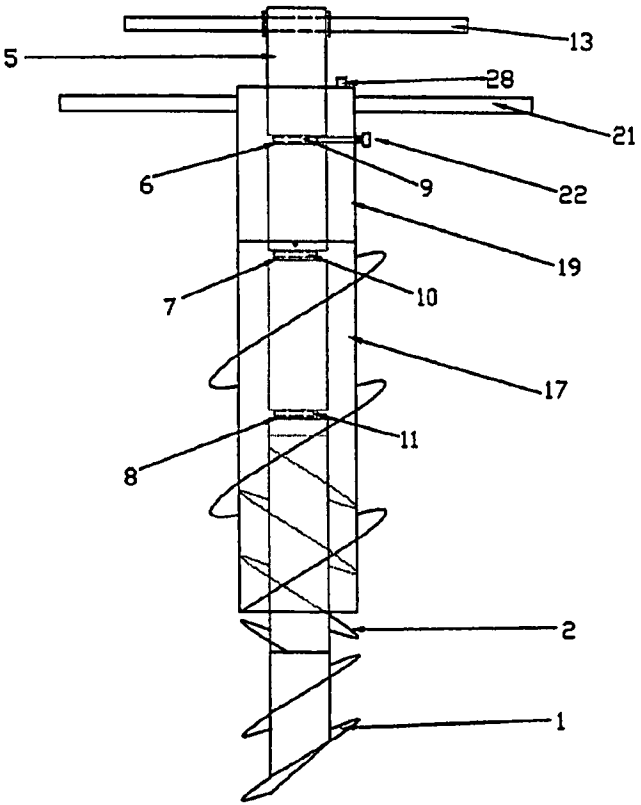
FIG. 2 is a frontal perspective view of the present invention.
Figure 3:
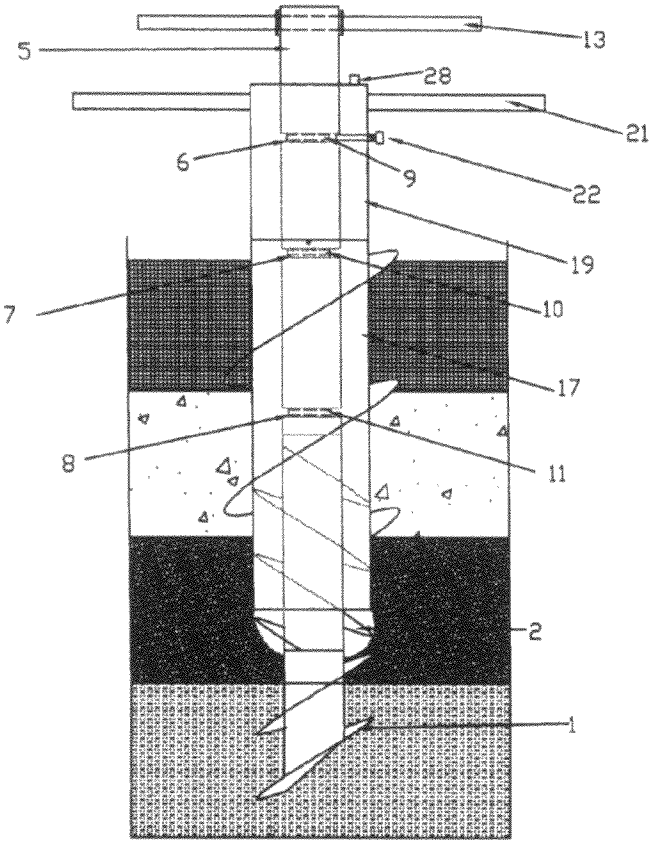
FIG. 3 is frontal view showing the said invention penetrating the subject matter while no matter enters the primary bore (No. 17).
Figure 4:
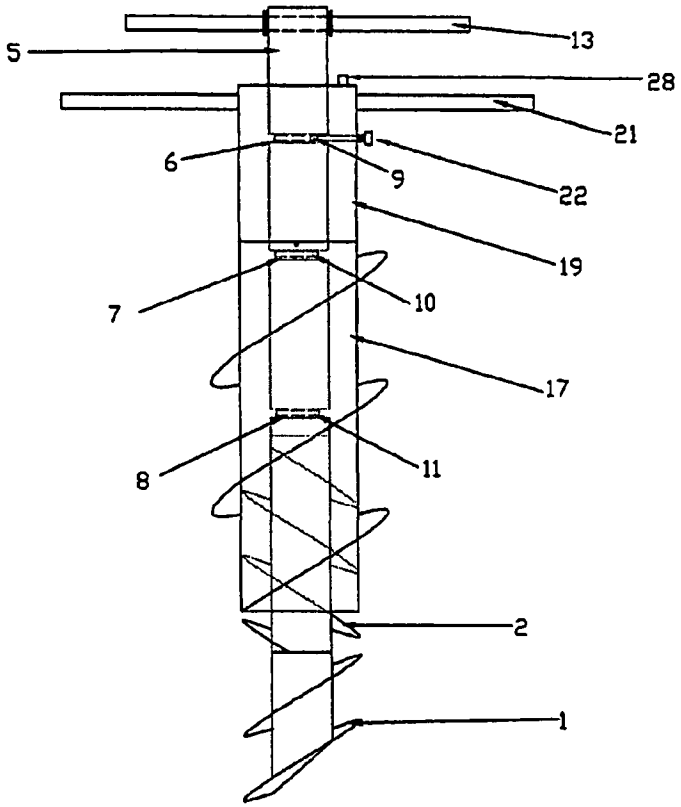
FIGS. 4 & 5 present a frontal view of the present invention boring vertically or horizontally into the subject matter $2^{nd}$ procedure.
Figure 5:
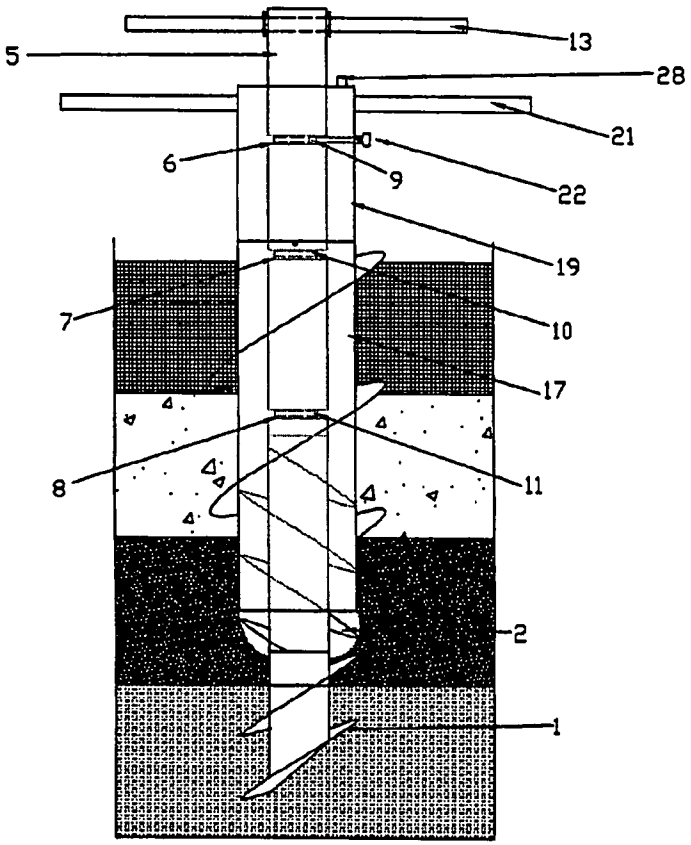
Figure 19:
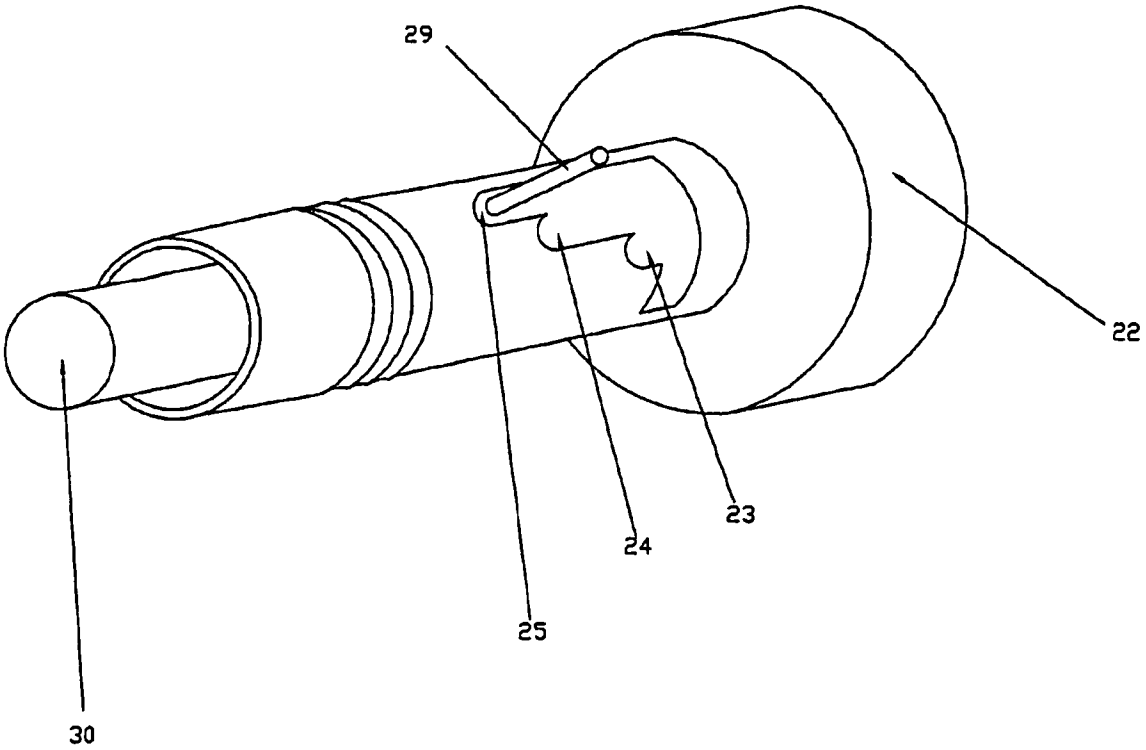
FIG. 19: is an isometric view of adjuster (No. 22) as adjustment (No. 25) moves the adjusting pin (No. 30) further towards the secondary drive shaft (No. 5) allowing the secondary drive shaft to couple with the Primary drive shaft (No. 19) and rotate as one unit in any of its locating slots (Nos. 9, 10 & 11).
Figure 20:
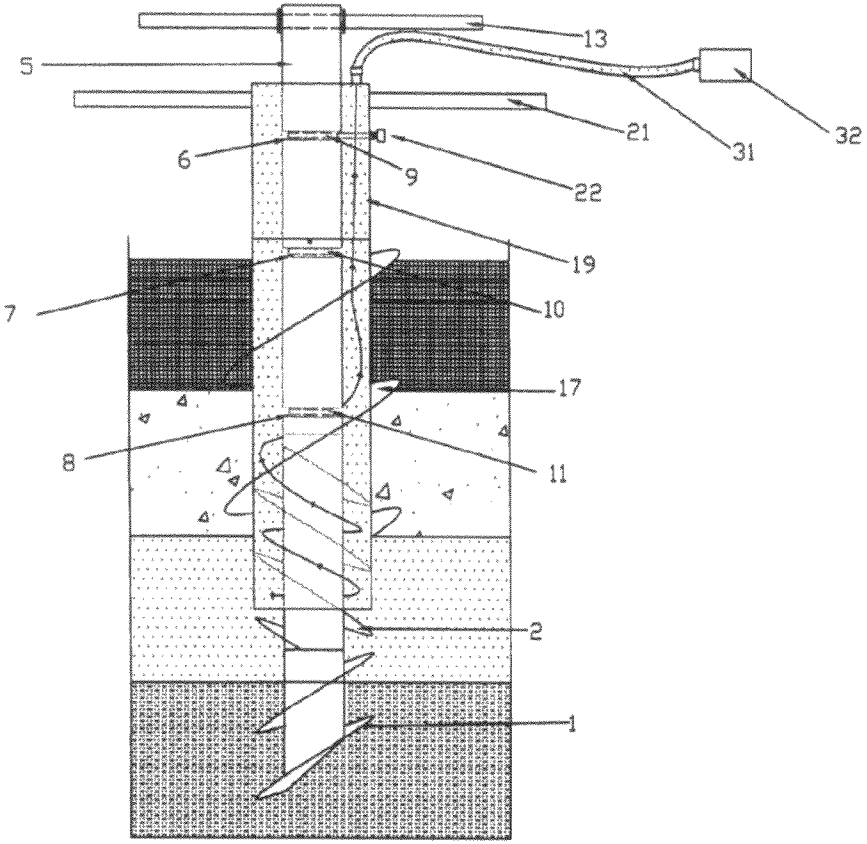
FIG. 20 shows a frontal view depicting removal of a gas sample and vapour extraction ($4^{th}$ procedure).
Figure 21:
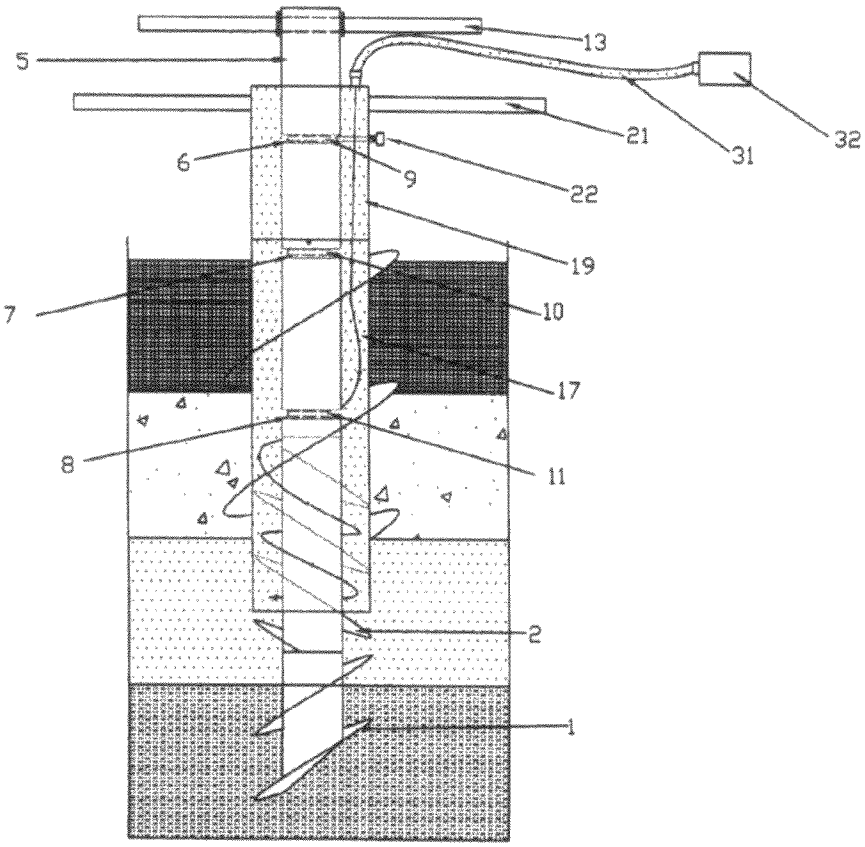
FIG. 21 is a frontal view demonstrating the present invention injecting a gas.
Figure 22:
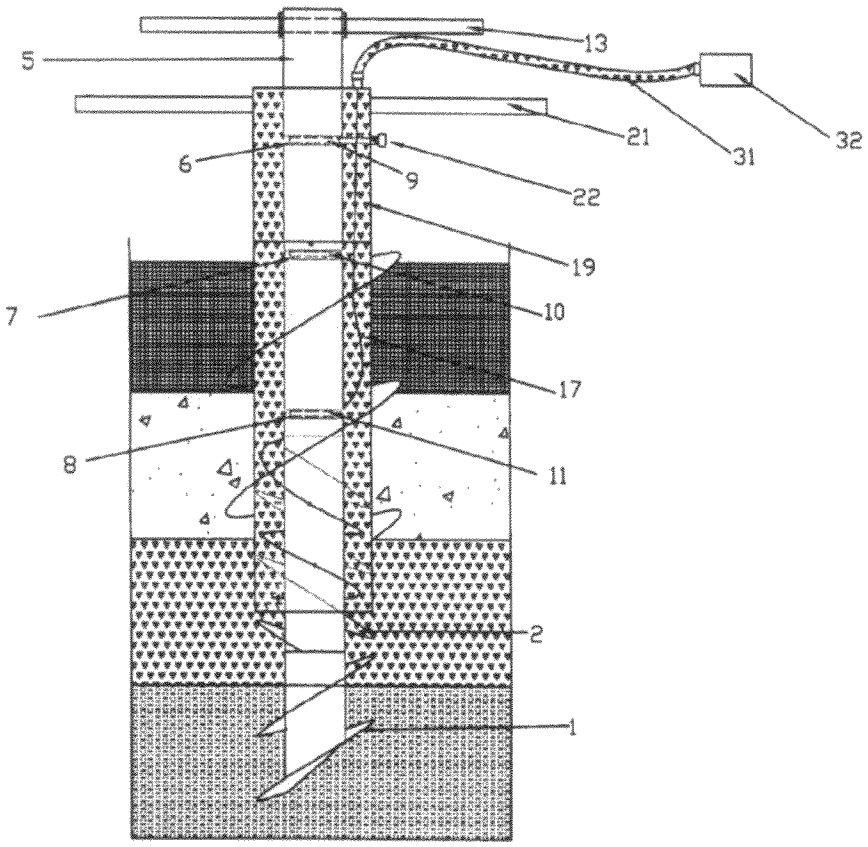
FIG. 22 is a frontal perspective view of the present invention in operation in the process of injecting a substance.
Figure 23:
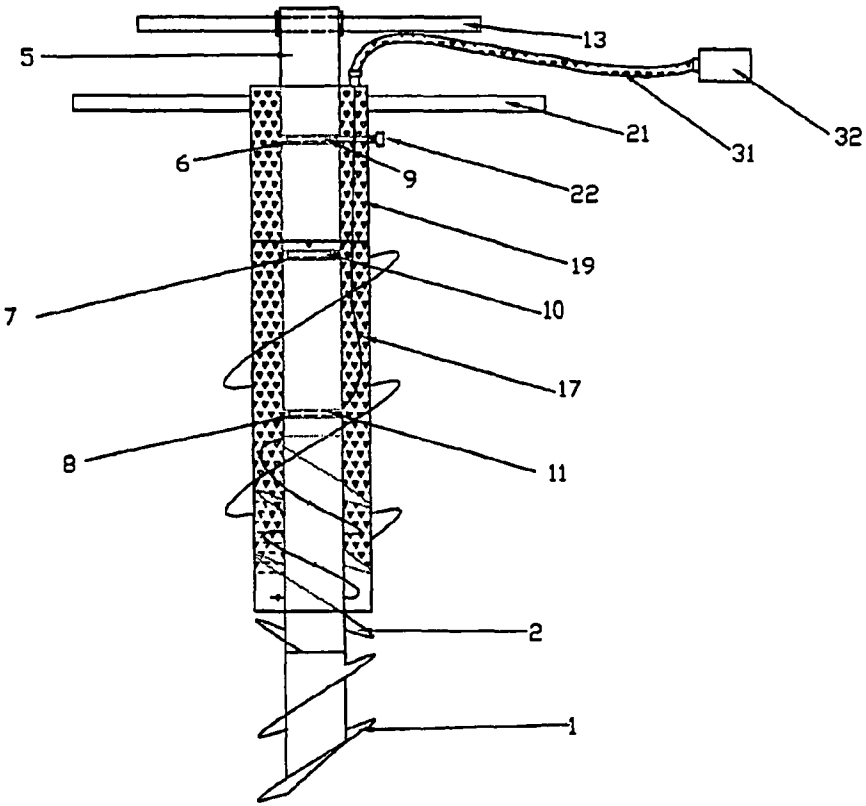
FIG. 23 shows the loading of the present invention ($2^{nd}$ procedure).

Boring vertical or horizontal 2nd procedure, the said invention consists of a primary screw (No. 17) and secondary screws (Nos. 1 & 2), the secondary screws are housed within the primary screw's bore, the secondary screws can rotate independently from the primary screw, but this procedure locks up both screws and as they are coupled by adjuster, both primary and secondary screws rotate as one (FIGS. 4, & 5). Secondary drive shaft (No. 5) in position (No. 6) and the primary drive shaft adjuster (No. 22) are set to adjustment (No. 25.) (FIG. 19) and when adjuster No. 22 is set to adjustment No. 25 the secondary shaft cannot rotate within the primary bore, both primary and secondary screws are coupled as one (FIG. 19).

Clockwise rotation FIG. 4, & FIG. 5 Primary screw (No. 17) penetrating and the secondary screws No. 1 & 2 rotate together with the primary screw No. 17 (not within). The secondary forward No. 1 and reverse No. 2 screws are made up of two screws on one shaft.

(1) The secondary forward screw No. 1 assists the primary screw in penetrating.

(2) The secondary reverse screw No. 2 maintains a clear bore within the primary screw, at all times and keeps pushing the material forward feeding the primary screw, allowing material to stay at the front of the primary screw in order to move to the surface, or up or along the primary screw, until the vertical or horizontal boring is complete, the reverse screw No. 2 expels in a clockwise direction.

At this point in operation the secondary forward screw is exposed to the subject matter and the secondary reverse screw is housed in the primary screw's bore, exposing part of the secondary reverse screw, ensuring that the intended subject matter doesn't enter the primary bore. After boring has been completed, rotations of both primary and secondary screws are stopped and the following procedures for sampling, extracting and injecting can now be executed.

The primary screw is rotated anticlockwise to remove the present invention from the subject matter, or the primary screw remains at the desired location and the secondary screws are removed leaving a clear primary bore.

The present invention can remove (1) A disturbed sample of the subject matter (2) An undisturbed sample of the subject matter (3) A Gas sample and extract vapours at any given depth without dismantling the tool. This is possible by changing rotational direction or position of the secondary forward and reverse screws, at the depth required to remove the sample.

Removing a disturbed sample 1st procedure.

At the targeted sampling depth, the secondary drive shaft rotating in position No. 6 and the primary drive shaft adjuster No. 22 set to No. 24. (FIG. 18). Note—when adjuster No. 22 is set to adjustment No. 24 the secondary drive shaft can rotate within the primary screw's bore. At the targeted sampling depth, Note—The primary screw No. 17 bore is clear of any product, due to the design of the secondary reverse screw No. 2.

Figure 6:
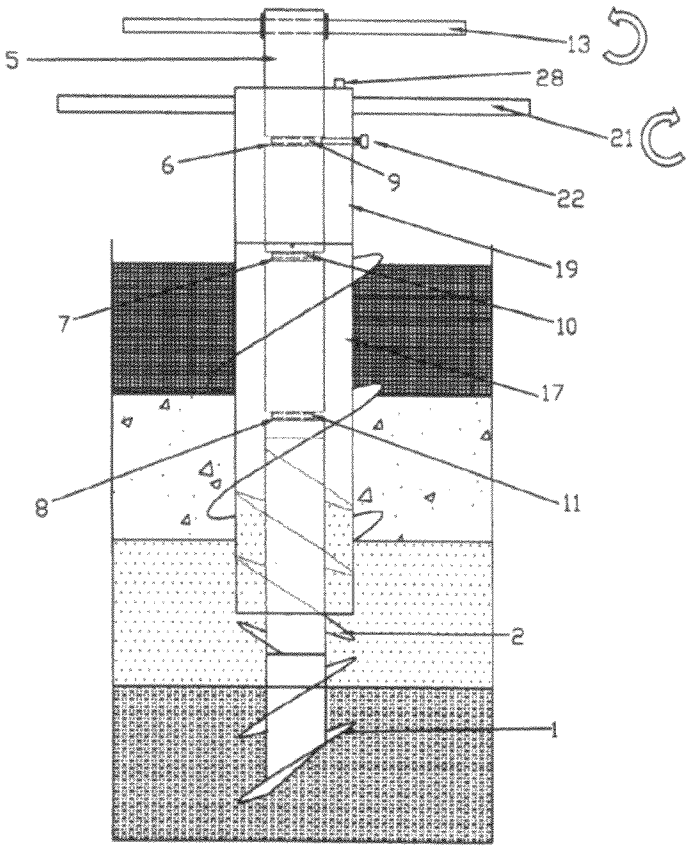
FIG. 6 is a frontal view depicting removal of a disturbed sample-$1^{st}$ Procedure.
Figure 7:
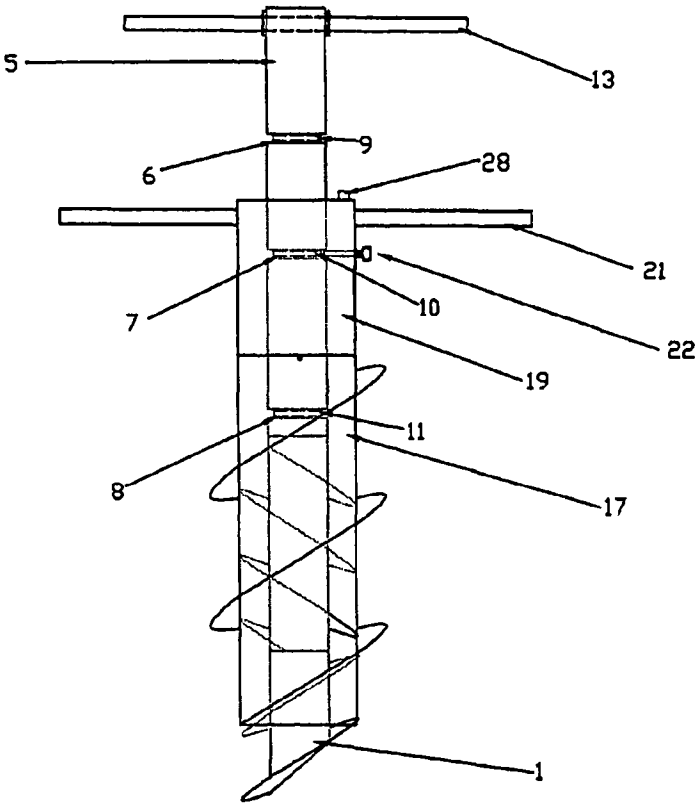
FIGS. 7 & 8 show a frontal view demonstrating removal of a disturbed sample-(2nd procedure: Part 1).
Figure 8:
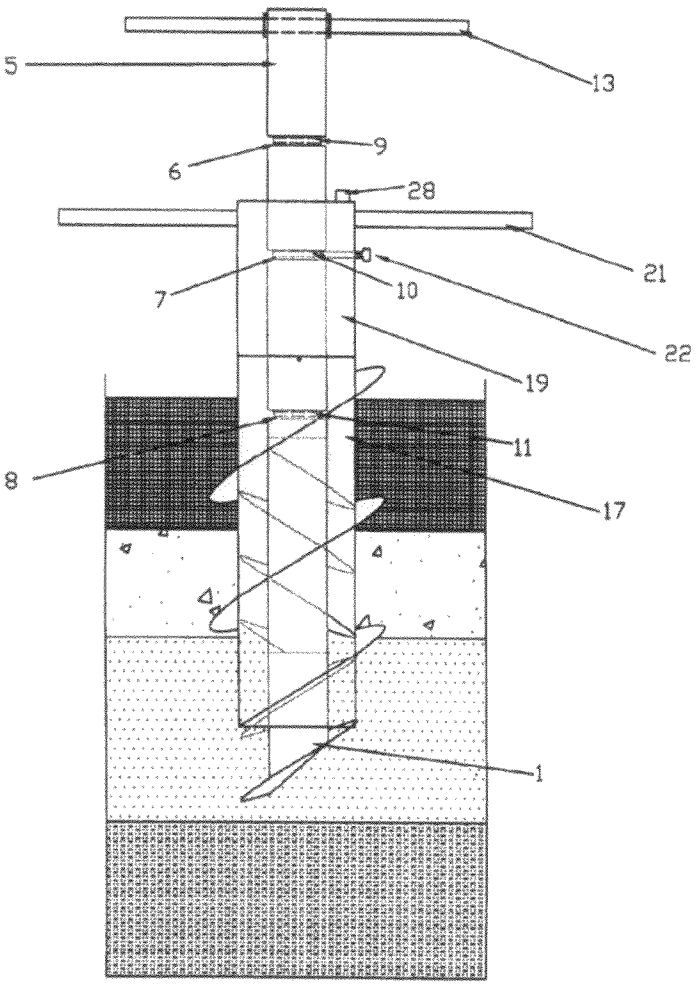
Figure 9:
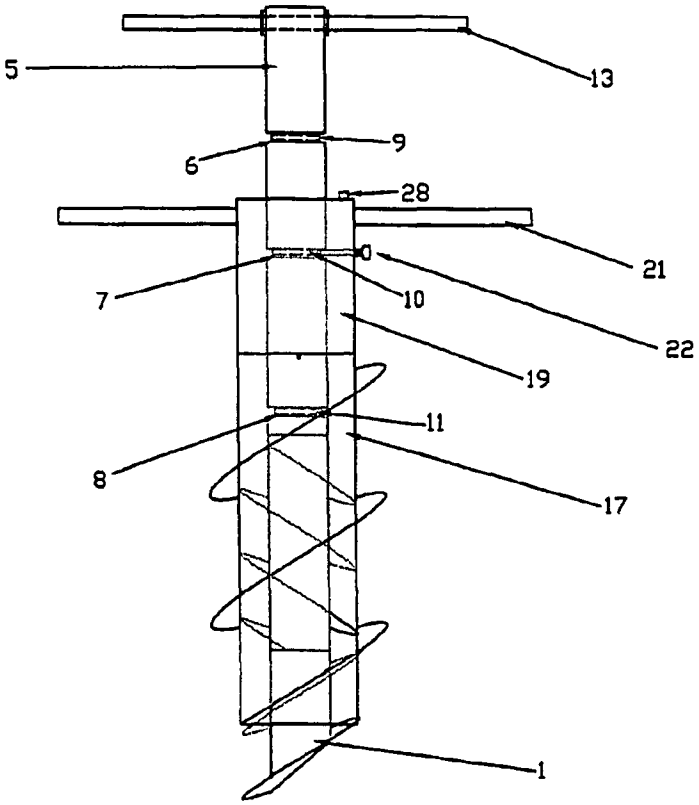
FIGS. 9 & 10 show a frontal view depicting removal of a disturbed sample-($2^{nd}$ procedure: Part 2).
Figure 10:
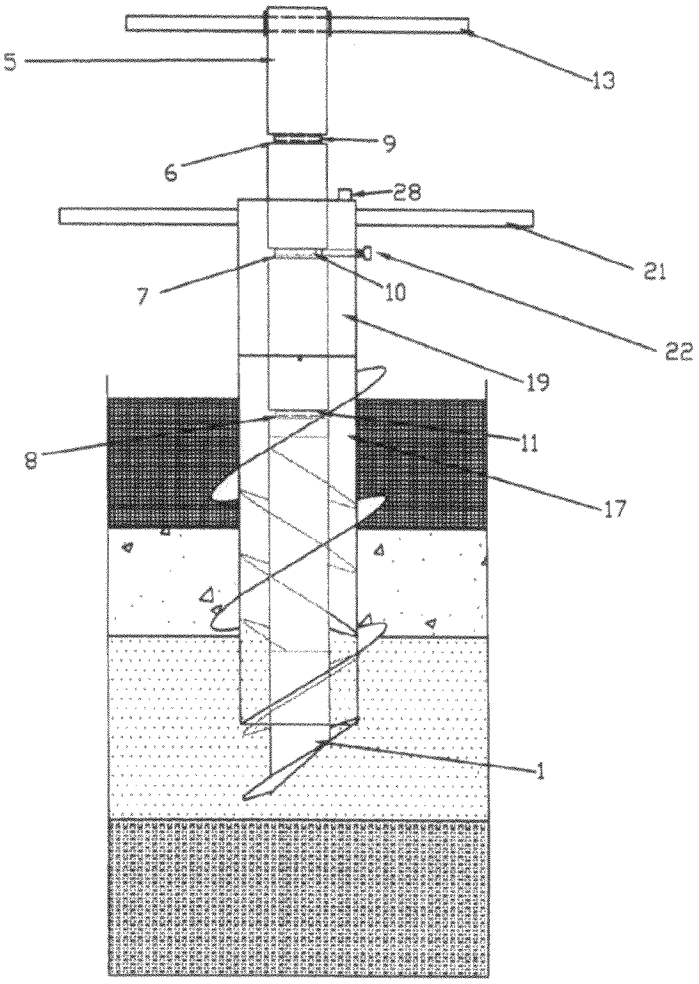

The secondary screws Nos. 1 & 2 are then rotated in an anticlockwise direction accompanied by the clockwise rotation of the primary screw No. 17 through the targeted sampling area FIG. 6. This anticlockwise rotation of the secondary screws results in transfer of the desired sample into the primary screw bore. This is possible on the secondary reverse screw No. 2. Note—Clockwise rotation of the secondary reverse screw No. 2 expels unwanted matter and in an anticlockwise rotation the secondary reverse screw No. 2 will take in the desired subject matter into the primary bore No. 17. The rotation of the secondary screws is stopped.

The primary screw No. 17 is then rotated in an anticlockwise direction for removal of the present invention. The said Invention is held over a collecting bin accompanied by the clockwise rotation of the secondary screws No 1& 2. This expels the desired sample and reveals it for observation and testing.

Removing a disturbed sample $2^{nd}$ procedure. Part 1.

The primary screw No. 17 bore remains clear of any matter, due to the design of the secondary reverse screw No. 2. The secondary forward screw No. 1 is immersed in the subject matter but it cannot contain or retain any matter. Matter was moving through the secondary forward screw No. 1 from entry and removal of all unwanted material was being picked up by the primary's No. 17 outer diameter screw.

At the targeted sampling depth, the secondary drive shaft No. 5 is moved to position No. 7 relocating the secondary screws ensuring that the secondary reverse screw No. 2 is not exposed and the majority of the secondary forward screw No. 1 is concealed in the primary screw's bore No. 17 exposing part of the secondary forward screw No. 1, to assist the primary screw in penetrating and taking in the sample, when the primary drive shaft adjuster No.22 is set to adjustment No. 24 the secondary drive shaft can rotate within the primary screw's bore No.17 (FIG. 18). The clockwise rotation of the primary forward screw No. 17 together with the clockwise rotation of the forward No. 1 and reverse No.2 screws. Through the targeted sampling area and the position of the secondary forward screw No. 1 in the primary bore No. 17 will result in the transfer of the sample into the Primary bore 17. The rotation of the secondary forward screw No. 1 is then stopped. The primary screw No. 17 is then rotated in an anticlockwise direction for removal of the present invention. The said invention is held over a collecting bin. The secondary screws No. 1 & 2 can be rotated in an anticlockwise direction or pushed back down to locating groove No. 6 FIG. 2, this reveals the desired sample for observation and testing.

Removing a disturbed sample—$2^{nd}$ Procedure. Part 2

At the targeted sampling depth, the secondary drive shaft No. 5 is moved to position No. 7 relocating the secondary screws ensuring that the secondary reverse screw No. 2 is not exposed and the majority of the secondary forward screw No. 1 is concealed in the primary bore No. 17, exposing part of the secondary forward screw No. 1, to assist the Primary screw in penetrating and taking in the sample, when the primary drive shaft adjuster No. 22 (FIG. 19) is set to adjustment No. 25 the secondary drive shaft No. 5 cannot rotate within the primary drive No. 19. Both Primary forward screw No. 17 and Secondary forward No. 1 and reverse No. 2 screws are coupled and rotate clockwise as one unit through the targeted sampling area and the position of the secondary forward screw No. 1 in the primary bore No. 17 will result in the transfer of the sample into the primary bore No.17.

The primary screw No. 17 is then rotated in an anticlockwise direction for removal of the said Invention. The Invention is held over a collecting bin. The secondary screws No. 1 & 2 can be rotated in an anticlockwise direction or pushed back down to its original position (FIG. 2), this reveals the desired sample for observation and testing Removing an Undisturbed Sample At the targeted sampling depth, the primary screw's bore is clear of any product, due to the design of the secondary reverse screw No. 2.

Figure 11:
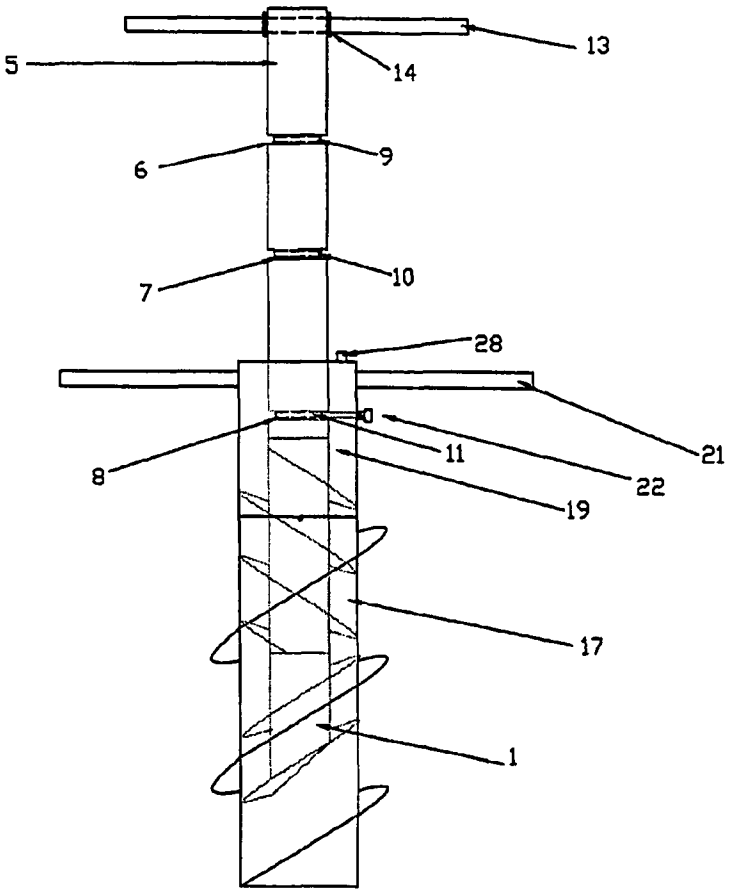
FIGS. 11 & 12: demonstrate removal of an undisturbed sample-(3rd procedure).
Figure 12:
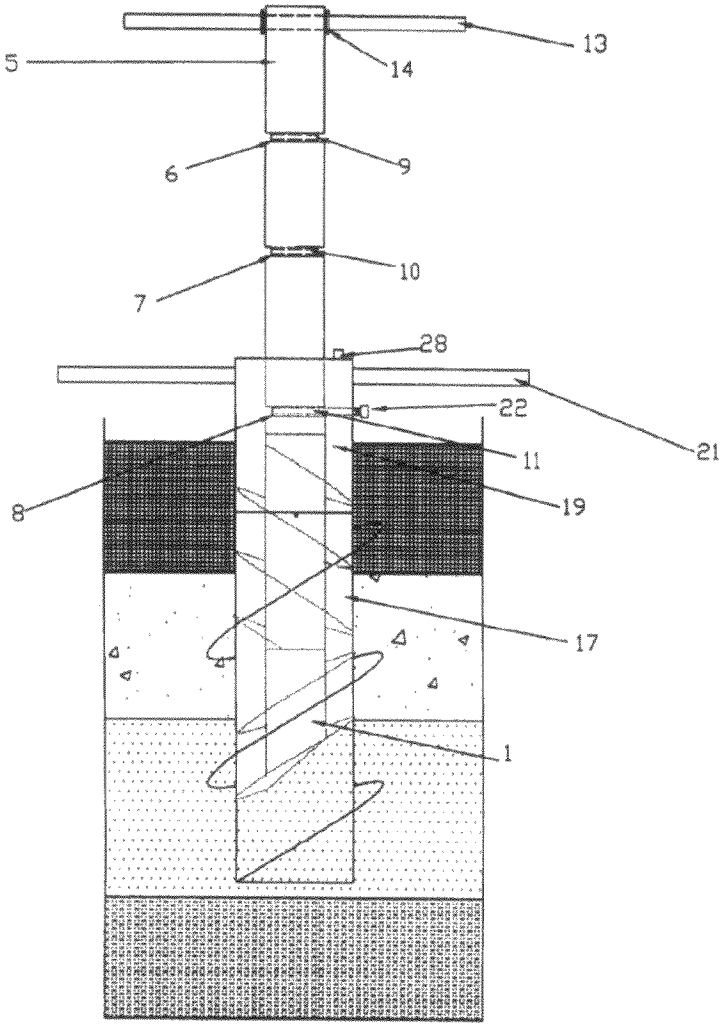

At the targeted sampling depth, rotation of both primary and secondary screws is stopped (FIGS. 11 & 12). The secondary drive shaft (No. 5) is in position (No. 8) and the primary drive shaft adjuster (No.22) is set (to No. 25) relocating the secondary screws in the primary bore (No. 17), leaving the required clear bore for the undisturbed sample. The primary screw is then rotated clockwise, moving the tool further into the intended subject matter of attention, the sample is then compacted into the free bore within the primary screw, after the targeted sampling distance has been completed rotation of the primary screw is stopped. The primary screw is then rotated in an anticlockwise direction for removal of the said invention. The invention is held over a collecting bin, the samples which were compacted into the primary screw's free bore (No.17), within the primary bore there is a removable cylinder (No. 15) with the compacted sample, the cylinder is removed with the sample.

The present invention can also be used as a medium for the extraction of a Gas and soil vapour for testing or venting by connecting a hose (No.31) to hose coupling (No.27) then to a vacuum pump (No.32).

The secondary drive shaft rotating in position (No. 6) and the primary drive shaft adjuster (No. 22) set to adjustment (No. 24) then the secondary drive shaft can rotate within the primary screw's bore at the targeted sampling area, while the primary screw bore is kept clear of any matter, due to the design of the secondary reverse screw (No. 2).

Figure 27:
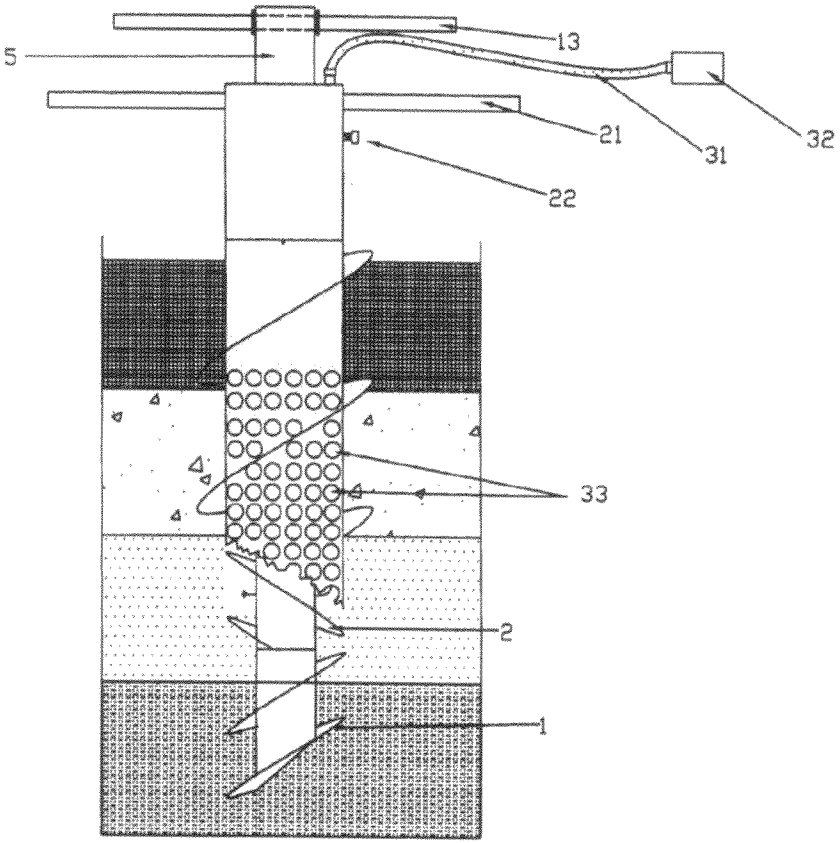
FIG. 27 depicts a cutaway frontal perspective view of a modified primary screw with drilled holes (No. 33) for gas extraction or venting ($4^{th}$ procedure) after boring into the subject matter.

Extraction takes place through the primary bore. When a larger soil area needs gas extraction or venting, a modified primary screw with drilled holes (No.33) can be used (FIG. 27). Extraction can now take place at the extraction point and along the drilled holes on the primary screws; the secondary screws (Nos. 1 & 2) can be rotated in a clockwise rotation to maintain a clear primary screw bore. This process can be repeated at different depths, allowing multiple extractions on one entry of the said invention into the subject matter.

The present invention may be loaded after entry and only at the targeted depth, the secondary drive shaft (No. 5) in position No. 6, with the primary drive shaft adjuster No. 22 (FIG. 18) set to adjustment No. 24 when adjuster No. 22 is set to adjustment No. 24, then the secondary drive shaft (No. 5) can rotate within the primary screw's bore No.17.

The secondary forward screw (No. 1) and secondary reverse screw (No. 2) are made up of two screws on one shaft with the secondary drive shaft(No. 5) rotating in position No. 6, the function of the secondary screws are as follows:

(1) The secondary forward screw No. 1 assists the primary screw No. 17 in penetrating clockwise.

(2) The secondary reverse screw No. 2 maintains a clear bore within the primary screw and injects or expels, in a clockwise rotation.

For injecting subject matter: (FIGS. 1, 18 & 22) at the targeted depth the primary screw (No. 17), the secondary forward (No. 1) and reverse (No. 2) screws are stopped. A hose (No. 31) from a source containing solids, granules, liquids, or a mixture of solids and liquids can be connected to the top of the primary drive shaft (No. 19), through the fitting (No. 27). The secondary screws (Nos. 1 & 2) are rotated in a clockwise direction moving and injecting the mixture into the target area. This is possible due to the design of the secondary reverse screw (No. 2). This process can be repeated at different depths, allowing multiple injections on one entry of the said invention into the subject matter.

For injecting a gas, (FIGS. 1, 18 & 21) at the targeted depth the primary screw (No. 17), the secondary forward (No. 1) and reverse (No. 2)screws are stopped, a high pressure gas is delivered from a pump (No. 32) through a hose (No. 31) to be injected and which is connected to the hose coupling (No. 27) on top of the primary drive shaft (No. 19). The gas is then injected in the appropriate area, the secondary screws (Nos. 1 & 2) are rotated clockwise to maintain a clear bore. This process can be repeated at different depths, allowing multiple injections on a single entry of the said invention into the area of the subject matter.

For loading the said invention 1$^{st}$ procedure, (FIGS. 1, 18 & 26) a container or holding bin is filled with matter. The injector FIG. 26 of the present invention enters the holding bin in a vertical position. The primary screw (No. 17) and secondary screws (Nos. 1 & 2) can rotate independently of each other. The secondary drive shaft (No. 5) in position No. 6, with the primary drive shaft adjuster (No. 22) set to adjustment No. 24, the secondary shaft can now rotate within the primary screw's bore. With the clockwise rotation of the primary screw, penetration occurs.

The secondary screws Nos. 1 & 2 are then rotated in an anticlockwise direction accompanied by the clockwise rotation of the primary screw (No. 17) through the subject matter. This anticlockwise rotation of the secondary screws and the position of the secondary reverse screw No. 2 in the primary bore (No. 17) results in transfer of the desired matter into the primary bore as the rotation of the secondary screws are stopped, the primary screw is then rotated in an anticlockwise direction for detachment. At this point the product is filled in the secondary reverse screw No. 2 and the said invention is loaded and ready to release its matter at any depth.

Loading of invention (2$^{nd}$ Procedure).

The present invention is void of any matter, and is placed in a horizontal position with the secondary drive shaft No. 5 on location No. 6, with the primary drive shaft adjuster No. 22 (FIG. 18) set to adjustment No. 24 Note when adjuster No. 22 is set to adjustment No. 24 the secondary drive shaft No. 5 can rotate within the primary screw's bore No. 17. A hose from a source containing Solids, granules, liquids or a mixture of solids and liquids can be connected to the top of the primary drive shaft No. 19, through hose coupling No. 27. The position and the clockwise rotation of the secondary drive shaft No.5 will fill the secondary reverse screw No.2 in the primary bore No. 17. Note. The said invention is loaded and ready to release its product at any depth.

Injection—2nd Procedure.

Figure 24:
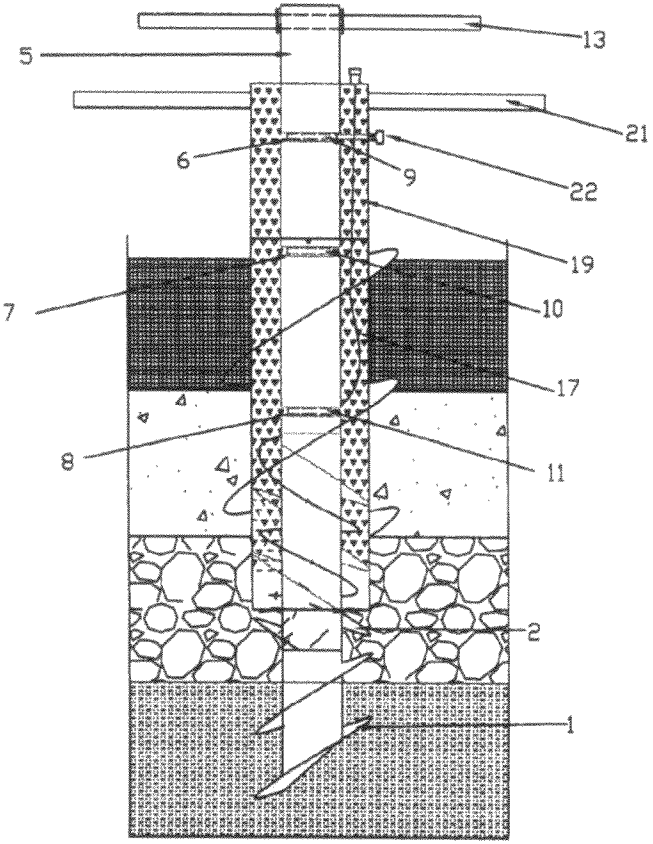
FIG. 24: is a frontal perspective view showing the present invention fully loaded and boring through the subject matter for injection.
Figure 25:
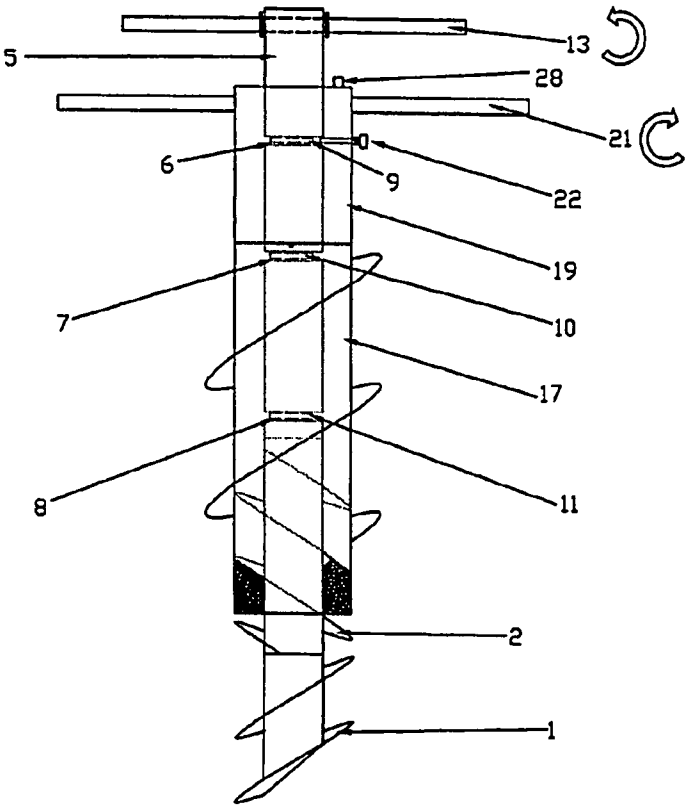
FIG. 25: is a frontal perspective view depicting the present invention removing a disturbed sample ($1^{st}$ Procedure).
Figure 26:
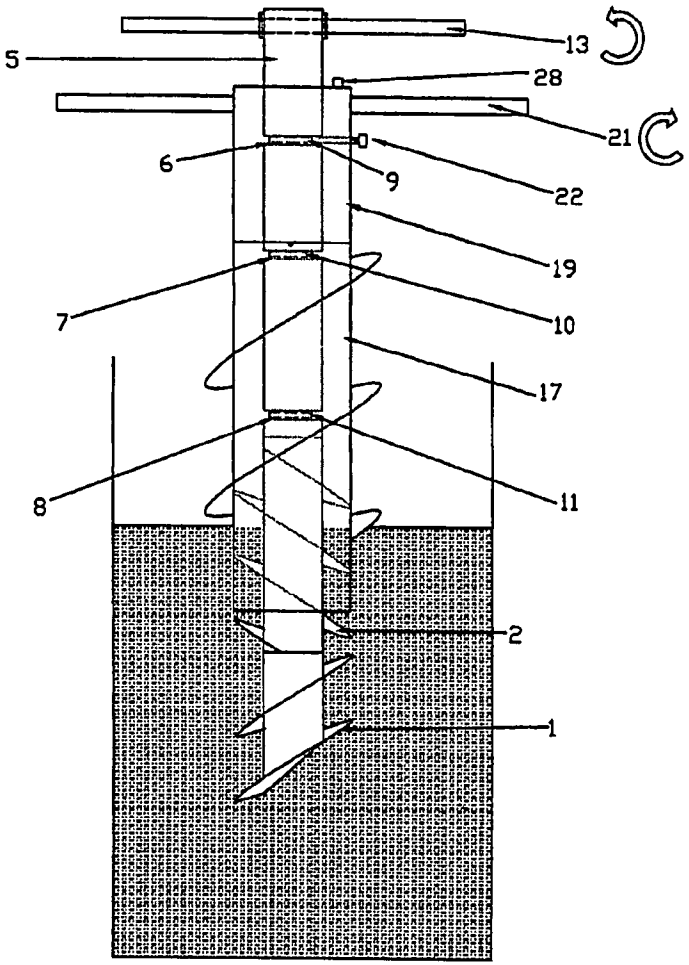
FIG. 26: is a frontal perspective view showing the loading of the present invention ($1^{st}$ procedure).

Entry of the loaded injector tool filled with Product to be injected into the intended subject matter of attention. FIG. 24 The present invention is loaded and ready to release a designated substance at any depth, the secondary drive shaft No. 5 on location, No. 6 with the primary drive shaft adjuster No. 22 set to No. 25. Note—when adjuster No. 22 is set to adjustment No. 25. FIG. 19. The secondary drive shaft can not rotate within the primary screw's bore, both primary and secondary screws are coupled together and rotate as one unit.

The secondary forward screw No. 1 assists the primary screw No. 17 in penetrating the desired subject matter in a clockwise rotation. The secondary reverse screw No. 2 is to hold the product while the present invention is in operation (this is possible when both primary and secondary screws are locked or coupled together and rotate as one unit) and release it at the appropriate depth. At the targeted releasing depth both screws are uncoupled by adjuster No. 22 set to adjustment No. 24, the screws can now rotate independently.

The primary screw's rotation can be stopped and the secondary screws may then be rotated in a clockwise direction, within the primary bore releasing any matter while in a clockwise rotation the secondary reverse screw (No. 2) expels matter.

After injection of the product into the subject matter, the rotation of the secondary screws is stopped. The primary screw is then rotated in an anticlockwise direction for removal of the present invention.

Glossary:—

1. Secondary forward screw with male splines.
2. Secondary reverse screw with female and male splines.
3. Locating pin and locking clip to couple No. 1 & No. 2 via male and female splines.
4. Locating pin and locking clip to couple No. 2 & No. 5 via male and female splines.
5. Secondary drive shaft.
6. Shaft adjustment locating groove allows the Secondary drive shaft No. 5 to rotate within the Primary drive shaft
7. Shaft adjustment locating groove allows the Secondary drive shaft No. 5 to rotate within the Primary drive shaft.
8. Shaft adjustment locating groove allows the Secondary drive No. 5 shaft to rotate within the Primary drive shaft.
9. Locating slot to couple Primary No. 19 and Secondary No. 5 drives to rotate as one unit.
10. Locating slot to couple Primary No. 19 and Secondary No. 5 drives to rotate as one unit.
11. Locating slot to couple Primary No19 and Secondary No. 5 drives to rotate as one unit.
12. Drilled hole to accommodate secondary drive handle No. 13.
13. Secondary drive handle.
14. Locking clips to keep handle No. 13 in position.
15. Removable cylinder for undisturbed samples.
16. Locking screws to lock cylinder No. 15 in place.
17. Primary forward screw with female threaded bore to accommodate Primary drive shaft No. 19.
18. Locking screws after connecting No. 17 and No. 19.
19. Primary drive shaft with male threads to couple No. 17.
20. Threaded bore to accommodate primary drive handles No. 21.
21. Primary drive handles with threaded ends.
22. Adjuster.
23. This adjustment (FIG. 17) allows the Secondary drive shaft to move to any of the following positions Nos. 6, 7 & 8.
24. This adjustment (FIG. 18) allows the Secondary drive shaft to rotate to any of the following positions Nos. 6, 7 & 8.
25. This adjustment (FIG. 19) allows the Secondary drive shaft to couple with the Primary drive shaft and rotate as one unit on any of the following No. 9, 10 & 11.
26. Threaded bore to accommodate adjuster No. 22.
27. Hose coupling.
28. Hose coupling cover.
29. Adjusting pin Lever. (FIG. 17, FIG. 18 & FIG. 19)
30. Adjusting Pin.. (FIG. 17, FIG. 18 & FIG. 19)
31. Hose. (FIG. 20, FIG. 21, FIG. 22, FIG. 23 & FIG. 27)
32. Pump. (FIG. 20, FIG. 21, FIG. 22, FIG. 23 & FIG. 27)
33. Primary screw modified with drilled holes. (FIG. 27)

The aforementioned characteristic features of the present invention are set forth in the following claims as are given hereunder:

What is claimed is:

1. An apparatus for drilling, the apparatus comprising:

a primary forward screw drill having a primary forward screw drill bore and drill threading;

a hollow cylindrical primary drive shaft coupled to the primary forward screw drill and having at least one perforation;

a secondary reverse screw drill housed within the primary forward screw drill bore, wherein drill threading of the secondary reverse screw drill is opposite in orientation to the drill threading of the primary forward screw drill;

a secondary forward screw drill operatively coupled with the secondary reverse screw drill, wherein the threading of the secondary forward screw drill is opposite in orientation to the threading of the secondary reverse screw drill;

a secondary drive shaft attached to the secondary reverse screw drill and housed within the primary drive shaft and primary forward screw drill bore; and at least three rotation channels recessed within the outer diameter of the secondary drive shaft.

2. The apparatus of claim 1, further comprising an indentation area located within each of the at least three rotation channels.

3. The apparatus of claim 1 wherein the secondary reverse screw drill is configured to rotate independently of the primary drive shaft in either a clockwise or counter-clockwise orientation.

4. The apparatus of claim 1, wherein the primary forward screw drill comprises a perforated section configured to allow venting or extraction of gas or fluids.

5. The apparatus of claim 1, further comprising a supply hose, operatively coupled with the secondary reverse screw drill, configured to inject a material through the secondary reverse screw drill.

6. An apparatus for drilling, the apparatus comprising:

a primary forward screw drill having a primary forward screw drill bore and drill threading;

a hollow cylindrical primary drive shaft coupled to the primary forward screw drill and having at least one perforation;

a secondary reverse screw drill housed within the primary forward screw drill bore, wherein drill threading of the secondary reverse screw drill is opposite in orientation to the drill threading of the primary forward screw drill;

a secondary forward screw drill operatively coupled with the secondary reverse screw drill, wherein the threading of the secondary forward screw drill is opposite in orientation to the threading of the secondary reverse screw drill;

a secondary drive shaft attached to the secondary reverse screw drill and. housed within the primary drive shaft and primary forward screw drill bore; and an adjuster configured to penetrate the at least one perforation in the primary drive shaft with an adjusting pin perpendicular to the primary drive shaft.

7. The apparatus of claim 6, wherein the adjusting pin is configured to penetrate the primary drive shaft only, allowing the secondary drive shaft to move longitudinally within the primary drive shaft.

8. The apparatus of claim 6, wherein the adjusting pin is configured to penetrate the primary drive shaft as well as one of the at least three rotation channels recessed within the outer diameter of the secondary drive shaft, allowing the secondary drive shaft to maintain a longitudinal position within the primary drive shaft and rotate independently from the primary drive shaft.

9. The apparatus of claim 6, wherein the adjusting pin is configured to penetrate the primary drive shaft as well as the indentation area located within one of the at least three rotation channels, coupling the primary drive shaft to the secondary drive shaft to rotate as a single unit.

10. The apparatus of claim 6, wherein the adjusting pin is configured to fix the secondary drive shaft in a plurality of positions within the primary forward screw drill to at least three rotation channels or indentation areas.

11. The apparatus of claim 10, wherein the secondary drive shaft is fixed within the primary forward screw drill such that the secondary forward screw drill is fully exposed and only a portion of the secondary reverse screw drill is exposed beyond the end of the primary forward screw drill.

12. The apparatus of claim 10, wherein the secondary drive shaft is fixed within the primary forward screw drill such that the secondary reverse screw drill and the secondary forward screw drill are concealed only exposing a portion of the secondary forward screw drill beyond the end of the primary forward screw drill.

13. The apparatus of claim 10, wherein the secondary drive shaft is fixed within the primary forward screw drill such that the secondary reverse screw drill and the secondary forward screw drill are withdrawn within the primary forward screw drill bore, leaving a hollow cavity within the primary forward screw drill bore.

14. The apparatus of claim 10, wherein the secondary drive shaft is configured to relocate within the primary drive shaft during a single drilling entry into a material.

15. An apparatus for drilling, the apparatus comprising:

a primary forward screw drill having as primary forward screw drill bore and drill threading;

a hollow cylindrical primary drive shaft coupled to the primary forward screw drill;

a secondary reverse screw drill housed within the primary forward screw drill bore, wherein drill threading of the secondary reverse screw drill is opposite in orientation to the drill threading of the primary forward screw drill; and a secondary forward screw drill operatively coupled. with the secondary reverse screw drill, wherein the threading of the secondary forward screw drill is opposite in orientation to the threading of the secondary reverse screw drill wherein the secondary reverse screw drill is housed within the primary forward screw drill bore and is attached to the secondary forward screw drill, wherein the secondary reverse screw drill is exposed at least three inches beyond the primary forward screw drill, and is configured to expel matter or discharge in any boring or drilling operation, with no matter or discharge passing through the primary forward screw drill bore.

16. The apparatus of claim 15, wherein the secondary forward screw drill can be replaced with different cutting tips dependent upon a subject matter for penetration.

17. An apparatus for drilling, the apparatus comprising:

a primary forward screw drill having a primary forward screw drill bore and drill threading;

a hollow cylindrical primary drive shaft coupled to the primary forward screw drill;

a secondary reverse screw drill housed within the primary forward screw drill bore, wherein drill threading of the secondary reverse screw drill is opposite in orientation to the drill threading of the primary forward screw drill; and a secondary forward screw drill operatively coupled with the secondary reverse screw drill, wherein the threading of the secondary forward screw drill is opposite in orientation to the threading of the secondary reverse screw drill;

wherein the secondary reverse screw drill is attached to at least one secondary forward screw drill, wherein the secondary reverse screw drill is configured to expel matter or discharge back to the secondary forward screw drill during a drilling procedure.

* * * * *